US011801654B2

(12) United States Patent
Chiang

(10) Patent No.: US 11,801,654 B2
(45) Date of Patent: Oct. 31, 2023

(54) STRUCTURE OF HONEYCOMB PAPER EXPANDING MACHINE

(71) Applicant: 1teck Automation Technology Co., Ltd., Tongxiang (CN)

(72) Inventor: Tung-Lung Chiang, New Taipei (TW)

(73) Assignee: 1teck Automation Technology Co., Ltd., Tongxiang (CN)

( * ) Notice: Subject to any disclaimer, the term of this patent is extended or adjusted under 35 U.S.C. 154(b) by 248 days.

(21) Appl. No.: 17/353,827

(22) Filed: Jun. 22, 2021

(65) Prior Publication Data

US 2022/0402230 A1 Dec. 22, 2022

(51) Int. Cl.
*B31F 1/00* (2006.01)
*B65H 27/00* (2006.01)
*B31D 3/02* (2006.01)

(52) U.S. Cl.
CPC ..... *B31F 1/0019* (2013.01); *B31D 3/0292* (2013.01); *B65H 27/00* (2013.01); *B31F 2201/00* (2013.01); *B65H 2701/1718* (2013.01); *Y10S 493/966* (2013.01)

(58) Field of Classification Search
CPC .. B31D 3/0292; B31F 1/0019; B31F 2201/00; Y10S 493/966; B65H 27/00
See application file for complete search history.

(56) References Cited

U.S. PATENT DOCUMENTS 5,063,647 A * 11/1991 Rohrer ..... B31D 3/0292 156/193
5,455,992 A * 10/1995 Kurschatke ..... D06C 3/06 26/99
5,789,059 A * 8/1998 Nomoto ..... B29D 99/0089 428/116
7,758,487 B2 * 7/2010 Elsayed ..... B31D 3/02 493/442
2004/0026844 A1 * 2/2004 Toriumi ..... B65H 27/00 271/109
2008/0145597 A1 * 6/2008 Hendren ..... B29D 99/0089 428/116
2015/0174881 A1 * 6/2015 Stoll ..... B31D 3/0223 428/116
2016/0332410 A1 * 11/2016 Brun ..... B32B 37/1292
2020/0262172 A1 * 8/2020 Tucker ..... B32B 7/12

* cited by examiner

*Primary Examiner* — Anna K Kinsaul
*Assistant Examiner* — Nicholas E Igbokwe
(74) *Attorney, Agent, or Firm* — Leong C. Lei

(57) ABSTRACT

An expanding machine includes a chassis, a feeding roller carrying a honeycomb paper, a guiding roller, and an expansion roller assembly including an upper expansion roller, a lower expansion roller, and a passage gap. The upper expansion roller includes upper projection assemblies that are staggered with respect to each other. Each of the projecting assemblies includes upper projecting portions and upper supporting portions that are alternate with respect to each other. The lower expansion roller includes projecting portions and supporting portions corresponding to the upper expansion roller. When the expansion roller assembly is put into rotation, the upper projecting portions correspond to the lower supporting portion, and the lower projecting portions correspond to the upper supporting portions, so that the projections that are separately arranged may pull and expand the honeycomb paper, making it not readily compress down the honeycomb paper or generating apparent compressing marking.

9 Claims, 7 Drawing Sheets

STRUCTURE OF HONEYCOMB PAPER EXPANDING MACHINE

TECHNICAL FIELD OF THE INVENTION

The present invention relates to a structure of a honeycomb paper expanding machine, and more particularly to a structure of a honeycomb paper expanding machine that provides an efficacy of making a piece of honeycomb paper not readily compressed or forming compressing marking so that the honeycomb paper so expanded may maintain an intact form of the outside appearance.

DESCRIPTION OF THE PRIOR ART

Honeycomb paper, or paper honeycomb, is a honeycomb paper structure involving the regular hexagonal shape that is found in the natural honeycombs and made for the purposes of fabricating a laminated structure as a green and energy-saving material. The honeycomb paper is a commonly and widely used packaging material due to being a green material, providing a good structure performance, exhibiting excellent cushioning, being of a low fabrication cost, and being available for specialized processing.

A piece of ordinary paper, after being folded and wrinkled, is good enough to provide a honeycombing effect. However, such a way of randomly processing of paper may not be suit for packaging purposes that often demand severer standards and may also not ensure the product of such a "honeycombed" paper structure. Packaging can be realized with paper lumps that are made by subjecting kraft paper that involves long fibers and has a high strength to processing with a specialized device, for the purposes of retaining, wrapping, or filling for commercial products, in order to provide protection to the commercial products. However, if the hexagonal structure of the paper honeycomb is damaged, the effect of cushioning may be deteriorated.

In a paper honeycomb expansion process performed with a known expanding machine, the paper honeycomb has to be expanded or stretched in a horizontal direction. Although consideration has been taken in respect of maintaining the honeycomb structure for the known expanding machine, the operation is such that annular projections are provided on expansion rolls and the annular projections are arranged in multiple rings that are spaced from each other, and the annular projections of an upper one of the expansion rolls are staggered with respect to the annular projections of a lower one of the expansion rolls, in order to prevent compressing the honeycomb structure. However, during the rotations of the expansion rolls, each annular projection exhibits a compressing position, which is fixed on a common line relative to the paper honeycomb, such that even the compressing positions are made staggered, there is clear and continuous compressing marking formed in the compressed parts. This affects the expanded honeycomb paper aesthetically and the continuous compressing marking makes the effect of cushioning protection virtually insignificant.

SUMMARY OF THE INVENTION

The primary objective of the present invention is that projecting portions are arranged separate from each other to pull and expand a honeycomb paper, so as to hold the honeycomb paper, while not readily compress down the honeycomb paper or forming apparent compressing marking, thereby maintaining the honeycomb structure to increase the resistance of the honeycomb paper against compression.

To achieve the above objective, the present invention provides an expanding machine, which is provided for expanding and stretching a honeycomb paper. The honeycomb paper includes a plurality of connecting portions and a plurality of cutoff portions. The expanding machine mainly comprises: a chassis, a feeding roller, a guiding roller, an expansion roller assembly, a plurality of first upper projection assemblies, a plurality of second upper projection assemblies, a plurality of first lower projection assemblies, and a plurality of second lower projection assemblies. The expansion roller assembly comprises an upper expansion roller, a lower expansion roller, and a passage gap. The first upper projection assemblies comprise a plurality of first upper projecting portions and a plurality of first upper supporting portions. The second upper projection assemblies comprise a plurality of second upper projecting portions and a plurality of second upper supporting portions. The first lower projection assemblies comprise a plurality of first lower projecting portions and a plurality of first lower supporting portions. The second lower projection assemblies comprise a plurality of second lower projecting portions and a plurality of second lower supporting portions.

In such a machine, the feeding roller is rotatably mounted at an end of the chassis and is provided for bear and support the honeycomb paper. The guiding roller is rotatably mounted to the chassis and is arranged at one side of the feeding roller. The expansion roller assembly is rotatably mounted to the chassis and is arranged at one side of the guiding roller that is opposite to the feeding roller. The lower expansion roller is arranged on one side of the upper expansion roller and rotatable in a direction opposite thereto. The passage gap is formed between the upper expansion roller and the lower expansion roller. The first upper projection assemblies are arranged in a manner of circumferentially surrounding and mounted to the upper expansion roller at intervals in an axial direction. The first upper projecting portions are arranged in a manner of being spaced from each other in a longitudinal direction. The first upper supporting portions are arranged alternate with respect the first upper projecting portions. The second upper projection assemblies are arranged in a manner of circumferentially surrounding and mounted to the upper expansion roller at intervals in an axial direction and are arranged alternate with respect to the first upper projection assemblies. The second upper projecting portions are arranged in a manner of being spaced from each other in a longitudinal direction and are located at one side of the first upper supporting portions. The second upper supporting portions are arranged alternate with respect to the second upper projecting portions and are located at one side of the first upper projecting portions. The first lower projection assemblies are arranged in a manner of circumferentially surrounding and mounted to the lower expansion roller at intervals in an axial direction. The first lower projecting portions are arranged in a manner of being spaced from each other in a longitudinal direction. The first lower supporting portions are arranged alternate with respect to the first lower projecting portions. The second lower projection assemblies are arranged in a manner of circumferentially surrounding and mounted to the lower expansion roller at intervals in an axial direction and are arranged alternate with respect to the first lower projection assemblies. The second lower projecting portions are arranged in a manner of being spaced from each other in a longitudinal direction and are located at one side of the first lower supporting portions. The second lower supporting portions are arranged alternate with respect to the second lower projecting portions and are located at one side of the first lower projecting portions.

When the expansion roller assembly is put into rotation, the honeycomb paper supported on the feeding roller is fed, in a horizontal direction, from the guiding roller to the expansion roller assembly, and under this condition, in the passage gap, the first upper projecting portions and the first lower supporting portions correspond in position to each other; the second upper projecting portions and the second lower supporting portions correspond in position to each other; the first lower projecting portions and the first upper supporting portions correspond in position to each other; and the second lower projecting portions and the second upper supporting portions correspond in position to each other. As such, the honeycomb paper is acted upon by frictional forces inside the expansion roller assembly to be expanded at the cutoff portions. At a time point when the honeycomb paper is passing through the passage gap, in one cross-section, portions of the honeycomb paper that are compressed by the expansion roller assembly are in the form of discrete points that are separate from each other. Such a way of compression provides an effect of holding the honeycomb paper, but does not readily compress down the honeycomb paper or form apparent compressing marking, so as to maintain the honeycomb structure to improve resistance of the honeycomb paper against compression.

Based on the above technology, a technical breakthrough is provided to overcome the problems of the known honeycomb paper expanding machine of which annular projection structures may cause apparent compressing marking and may damage the honeycomb paper, causing deterioration to aesthetics and cushioning performance, and the advantages of this invention provided above may thus be achieved.

DETAILED DESCRIPTION OF THE PREFERRED EMBODIMENT

Figure 1:
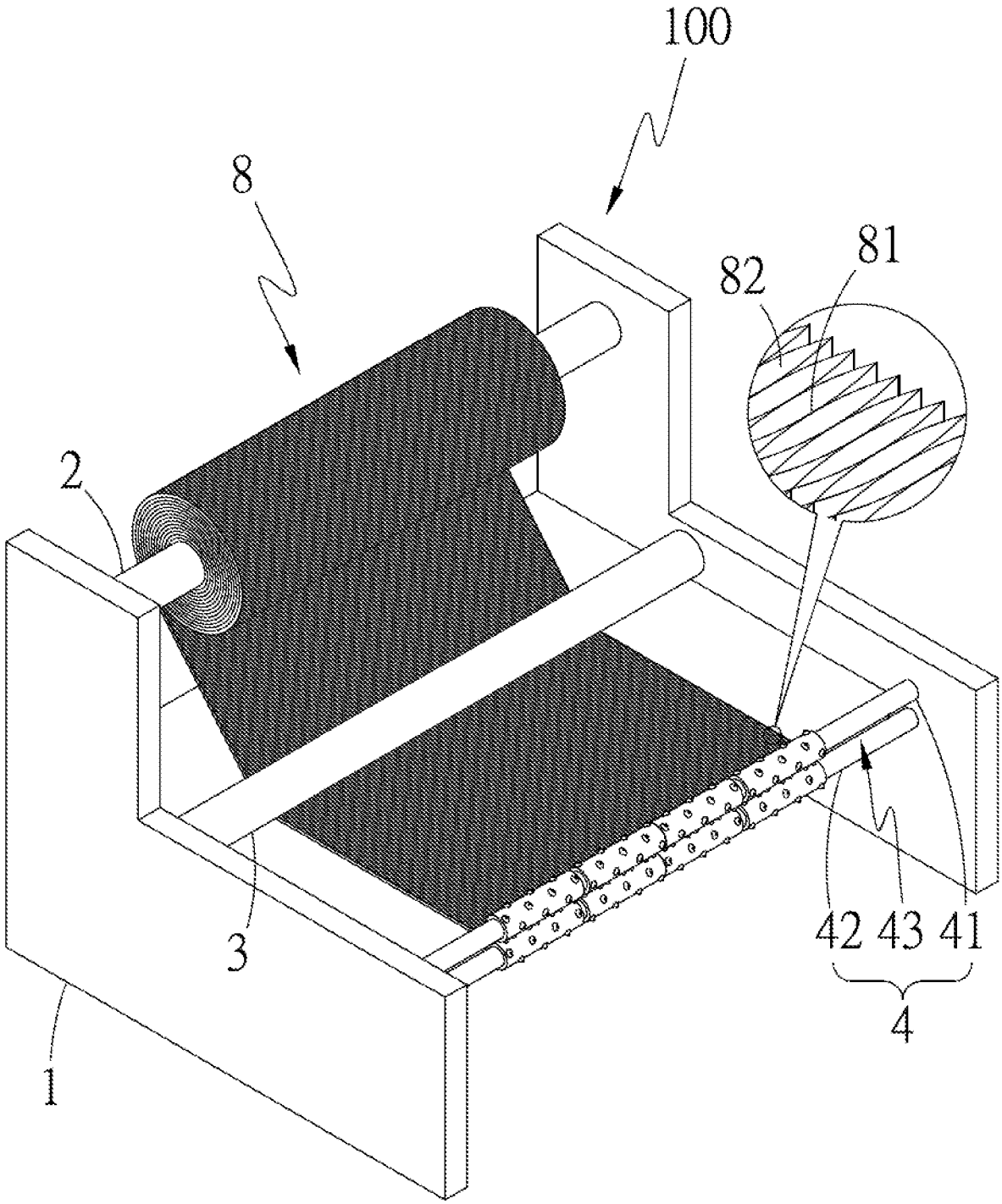
FIG. 1 is a perspective view showing a preferred embodiment of the present invention.
Figure 2:
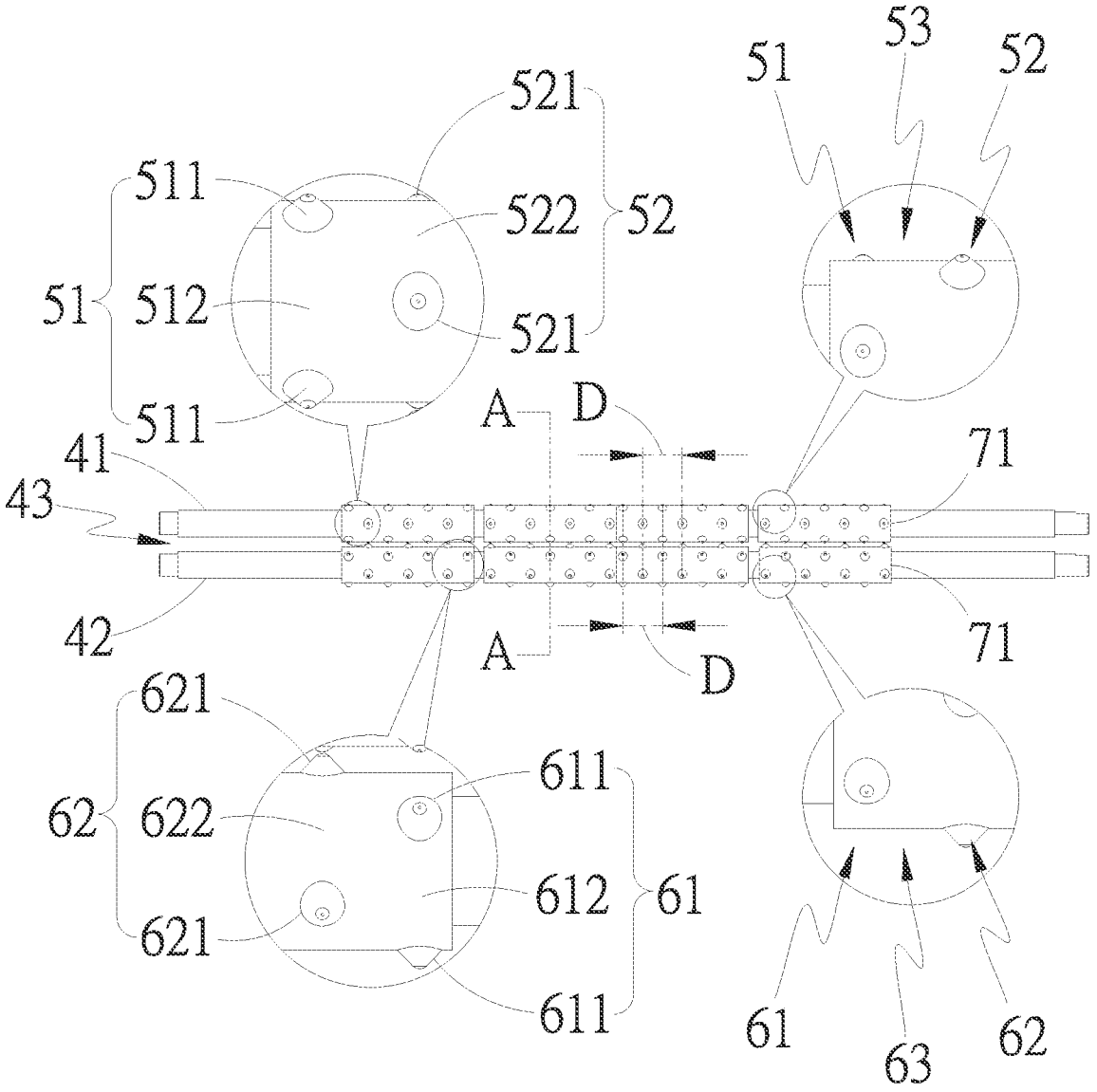
FIG. 2 is a plan view showing an expansion roller assembly of the preferred embodiment of the present invention.
Figure 3:
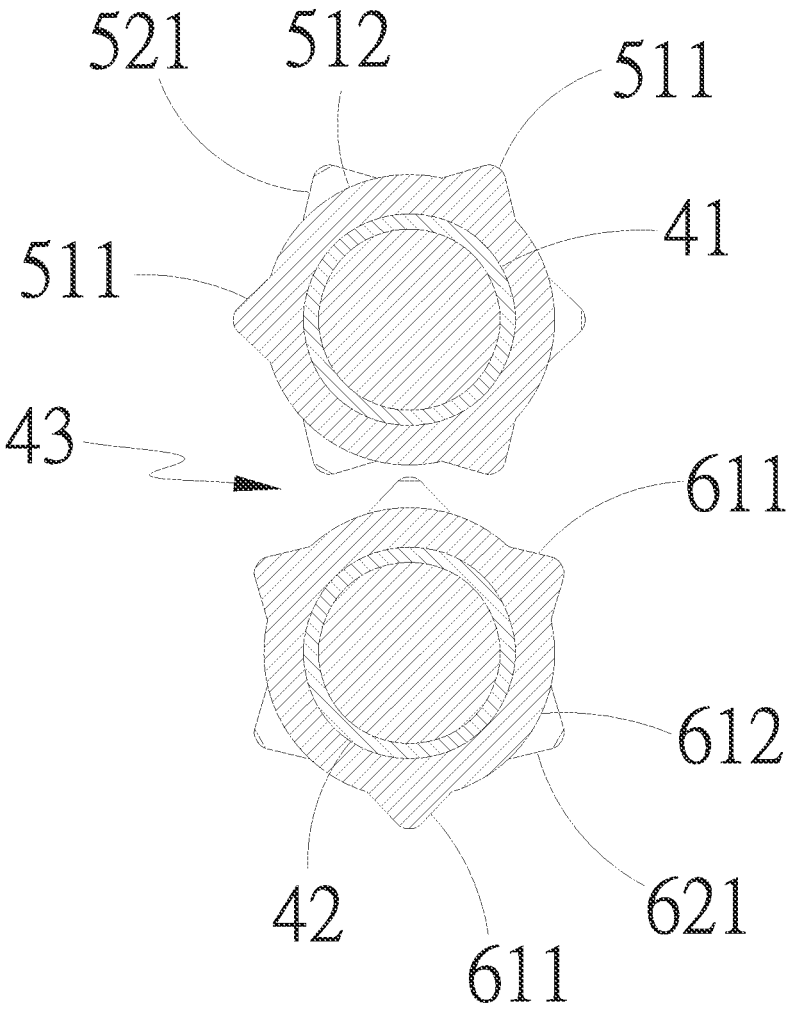
FIG. 3 is a cross-sectional view taken along line A-A of FIG. 2.

As shown in FIGS. 1-4, which are respectively a perspective view showing a preferred embodiment of the present invention, a plan view showing an expansion roller assembly of the preferred embodiment of the present invention, a cross-sectional view taken along line A-A of FIG. 2, and a schematic view illustrating operation of the preferred embodiment of the present invention, it can be clearly seen from the drawings that the present invention provides an expanding machine 100, which is provided for bearing and expanding a honeycomb paper or paper honeycomb 8. The honeycomb paper 8 is made up of a plurality of connecting portions 81 and a plurality of cutoff portions 82. The expanding machine 100 mainly comprise:

- a chassis 1;
- a feeding roller 2, which is rotatably mounted at an end of the chassis 1 and is provided for bear and support the honeycomb paper 8;
- a guiding roller 3, which is rotatably mounted to the chassis 1 and is arranged at one side of the feeding roller 2;
- an expansion roller assembly 4, which is rotatably mounted to the chassis 1 and is arranged at one side of the guiding roller 3 that is opposite to the feeding roller 2, wherein the expansion roller assembly 4 comprises an upper expansion roller 41, a lower expansion roller 42 arranged on one side of the upper expansion roller 41 and rotatable in a direction opposite thereto, and a passage gap 43 formed between the upper expansion roller 41 and the lower expansion roller 42;
- a plurality of first upper projection assemblies 51, which are arranged in a manner of circumferentially surrounding and mounted to the upper expansion roller 41 at intervals in an axial direction, wherein the first upper projection assemblies 51 each comprise a plurality of first upper projecting portions 511 arranged in a manner of being spaced from each other in a longitudinal direction, and a plurality of first upper supporting portions 512 arranged alternate with respect to the first upper projecting portions 511;
- a plurality of second upper projection assemblies 52, which are arranged in a manner of circumferentially surrounding and mounted to the upper expansion roller 41 at intervals in an axial direction and are arranged alternate with respect to the first upper projection assemblies 51, wherein the second upper projection assemblies 52 each comprise a plurality of second upper projecting portions 521 arranged in a manner of being spaced from each other in a longitudinal direction and are located at one side of each of the first upper supporting portions 512, and a plurality of second upper supporting portions 522 arranged alternate with respect to the second upper projecting portions 521 and are located at one side of each of the first upper projecting portions 511;
- a plurality of first lower projection assemblies 61, which are arranged in a manner of circumferentially surrounding and mounted to the lower expansion roller 42 at intervals in an axial direction, wherein the first lower projection assemblies 61 each comprises a plurality of first lower projecting portions 611 arranged in a manner of being spaced from each other in a longitudinal direction, and a plurality o first lower supporting portions 612 arranged alternate with respect to the first lower projecting portions 611;
- a plurality of second lower projection assemblies 62, which are arranged in a manner of circumferentially surrounding and mounted to the lower expansion roller 42 at intervals in an axial direction and are arranged alternate with respect to the first lower projection assemblies 61, wherein the second lower projection assemblies 62 each comprises a plurality of second lower projecting portions 621 arranged in a manner of being spaced from each other in a longitudinal direction and are located at one side of each of the first lower supporting portions 612, and a plurality of second lower supporting portions 622 arranged alternate with respect to the second lower projecting portions 621 and are located at one side of each of the first lower projecting portions 611;

at least one first fitting joint portion 71, wherein the first upper projection assemblies 51 and the second upper projection assemblies 52 are arranged on the first fitting joint portion 71;

at least one second fitting joint portion 72, wherein the first lower projection assemblies 61 and the second lower projection assemblies 62 are arranged on the second fitting joint portion 72;

a plurality of upper spacing portions 53, which are located between the first upper projection assemblies 51 and the second upper projection assemblies 52;

a plurality of lower spacing portions 63, which are located between the first lower projection assemblies 61 and the second lower projection assemblies 62;

wherein the expansion roller assembly 4, during rotation, is operable such that the first upper projecting portions 511 and the first lower supporting portions 612 that are located at one side of the passage gap 43 are set to correspond, in position, to each other; the second upper projecting portions 521 and the second lower supporting portions 622 that are located at one side of the passage gap 43 are set to correspond, in position, to each other; the first lower projecting portions 611 and the first upper supporting portions 512 that are located at one side of the passage gap 43 are set to correspond, in position, to each other; and the second lower projecting portions 621 and the second upper supporting portions 522 that are located at one side of the passage gap 43 are set to correspond, in position, to each other.

The above description provides an understanding to the structure of the present invention, and based on a combination of such a structure, an effect of being not readily compressed and forming no apparent compressing marking can be achieved, such that the structure of the honeycomb paper 8, after being expanded, may maintain an intact outside appearance. It can be clearly seen from the drawings that the chassis 1, the feeding roller 2, the guiding roller 3 and the expansion roller assembly 4 can be made of corrugated paper, plastics, wood, or metallic materials, and the feeding roller 2 and the expansion roller assembly 4 are respectively arranged at two opposite end portions of the chassis 1, while the guiding roller 3 is arranged between the feeding roller 2 and the expansion roller assembly 4. The first upper projection assemblies 51 and the second upper projection assemblies 52 may include multiple sets, such as being respectively of four sets and three sets jointly arranged on the first fitting joint portion 71, and the first lower projection assemblies 61 and the second lower projection assemblies 62 may also include multiple sets, such as being respectively of four sets and three sets jointly arranged on the second fitting joint portion 72. The first fitting joint portion 71 and the second fitting joint portion 72 are both rubber sleeves. The first upper projecting portions 511, the second upper projecting portions 521, the first lower projecting portions 611, and the second lower projecting portions 621 are arranged, for an example of illustration in the instant embodiment, in the form of a surface projecting portion having a conic configuration, and the first upper supporting portions 512, the second upper supporting portions 522, the first lower supporting portions 612, and the second lower supporting portions 622 are arranged, for an example of illustration in the instant embodiment, in the form of a circular arc surface of the upper expansion roller 41 and the lower expansion roller 42.

To use, the honeycomb paper 8 is wrapped around and thus supported on the feeding roller 2, and the honeycomb paper 8 is extended to curve around one side of the guiding roller 3 to pass between the upper expansion roller 41 and the lower expansion roller 42. A user may pull the honeycomb paper 8, and the upper expansion roller 41 and the lower expansion roller 42 are rotated in opposite directions, such that the honeycomb paper 8 arranged on f the feeding roller 2 is moved through the guiding roller 3 to feed, in a horizontal direction, to the expansion roller assembly 4, with the cutoff portions 82 of the honeycomb paper 8 being slightly expanded. Under such a condition, the first upper projecting portions 511 and the first lower supporting portions 612 that are located at one side of the passage gap 43 correspond, in position, to each other; the second upper projecting portions 521 and the second lower supporting portions 622 that are located at one side of the passage gap 43 correspond, in position, to each other; the first lower projecting portions 611 and the first upper supporting portions 512 that are located at one side of the passage gap 43 correspond, in position, to each other; and the second lower projecting portions 621 and the second upper supporting portions 522 that are located at one side of the passage gap 43 correspond, in position, to each other, and in the instant embodiment, each of the projecting portions 511, 521, 611, 621 has a height that is slightly smaller than a height of the passage gap 43, so as to act on the honeycomb paper 8 through contact therewith.

Figure 4:
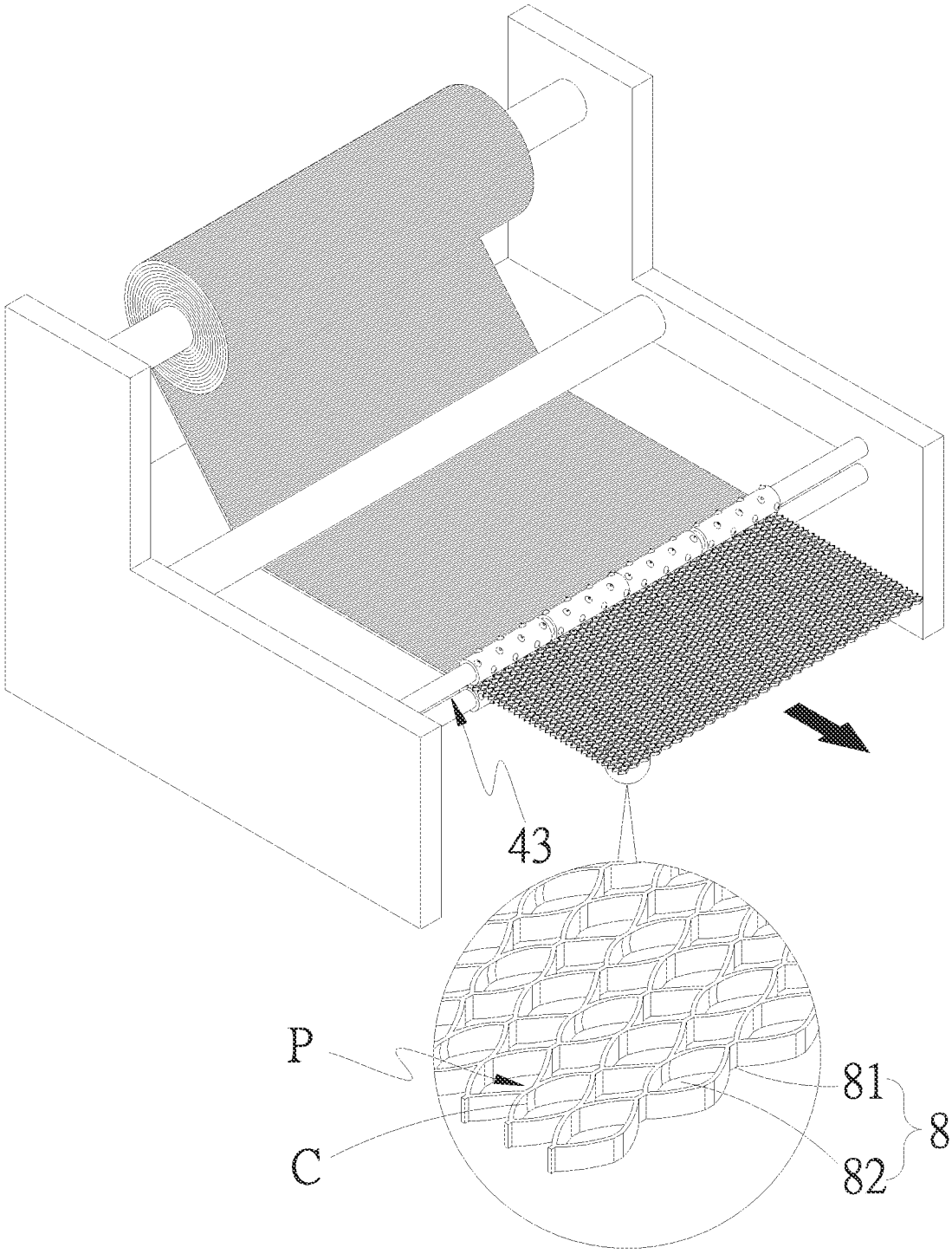
FIG. 4 is a schematic view illustrating operation of the preferred embodiment of the present invention.

As shown in FIG. 4, when the position of acting is at apertures of the cutoff portions 82, no acting can be generated to pull out and expand the honeycomb paper 8, and when the position of acting is at the connecting portions 81 of the honeycomb paper 8, firstly, a certain effect of retaining may be achieved for retaining the honeycomb paper 8, and also, a user's pulling force may be applied in combination therewith to effectively expand the cutoff portions 82 of the honeycomb paper 8. Further, at one time point of the honeycomb paper 8 passing through the passage gap 43, in one common cross-section of the honeycomb paper 8, portions P that are compressed by the expansion roller assembly 4 are discrete points that are separate, and with the honeycomb paper 8 advanced, in a next cross-section of the honeycomb paper 8, portions P that are compressed by the expansion roller assembly 4 are also discrete points that are separate, but are staggered with respect to the previous group of compressed points. In other words, the portion of the honeycomb paper 8 that has been pulled out includes compressed portions P that are discrete points that are separate from each other (see FIG. 4, the compressed portions of the honeycomb paper 8 being shown slightly curved at C), and the projecting portions and the supporting portion have height difference, making the contact area small, and thus, the honeycomb paper 8 can be effectively retained and the honeycomb paper 8 is not readily compressed flat or generates an apparent compressing marking, thereby helping maintain the honeycomb structure to enhance the resistance of the honeycomb paper 8 against compression.

Further, to allow the honeycomb paper 8 to be pulled out steadily, there need a certain number of surface projections and supporting portions in order to generate an acting force to pull out the honeycomb paper 8. Consequently, the spacing between the surface projections should not be excessively large; however, if the spacing between the projections is excessively small, then there would be a dense arrangement of the projections on the surface of the upper expansion roller 41 or the lower expansion roller 42, making it difficult for manufacturing the expansion roller assembly 4. Thus, the spacing distance D (as shown in FIG. 2) of each of the first upper projecting portions 511, the spacing distance D of each of the second upper projecting portions 521, the spacing distance D of each of the first lower projecting portions 611, and the spacing distance D of each of the second lower projecting portions 621 is preferably 5 mm to 100 mm. When the position of acting is at the honeycomb apertures, the surface projections would penetrate into the apertures, and when the honeycomb paper 8 is pulled out, the surface projection disengage from and the move out of the apertures, and consequently, if the height of the surface projections is excessively large, edge portions of the apertures may be damaged, and if the height of the surface projections is excessively small, making the upper expansion roller 41 and the lower expansion roller 42 too close to each other, a situation of compressing down the honeycomb paper 8 may result. Thus, the height of the surface projections is preferably 1-5 mm.

Figure 5:
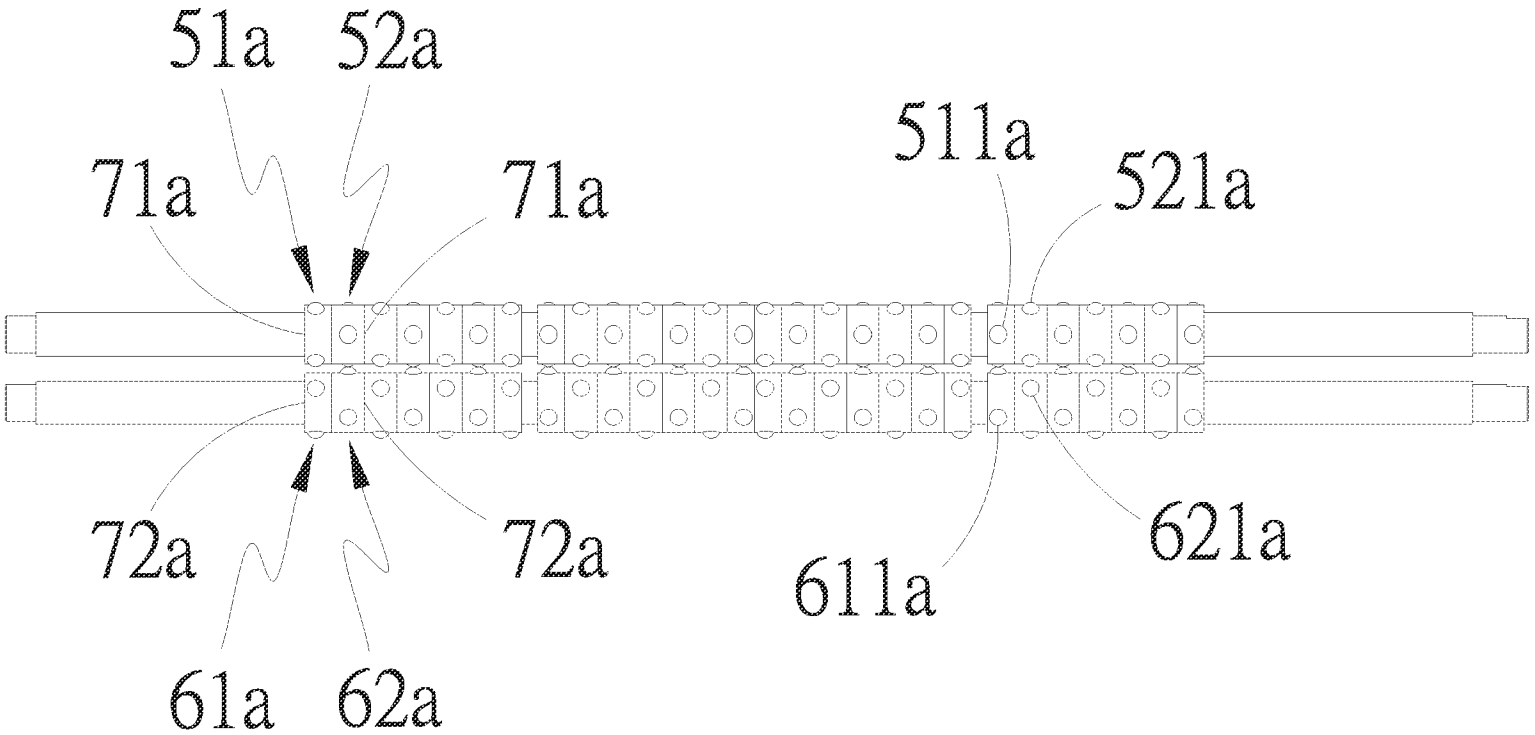
FIG. 5 is a plan view showing an expansion roller assembly according to another preferred embodiment of the present invention.

As shown in FIG. 5, which is a plan view showing an expansion roller assembly according to another preferred embodiment of the present invention, it can be clearly seen from the drawings that the instant embodiment is generally similar to the previous embodiment and is differently structured such that the first upper projection assemblies 51*a*, the second upper projection assemblies 52*a*, the first lower projection assemblies 61*a*, and the second lower projection assemblies 62*a* are each arranged on an individual first fitting joint portion 71*a* or second fitting joint portion 72*a*, to allow a user to freely adjust the spacing distance between the first upper projection assemblies 51*a* and the second upper projection assemblies 52*a*, or the spacing distance between the first lower projection assemblies 61*a* and the second lower projection assemblies 62*a*. Further, in the instant embodiment, the first upper projecting portions 511*a*, the second upper projecting portions 521*a*, the first lower projecting portions 611*a*, and the second lower projecting portions 621*a* are of an arc configuration (such as a hemisphere) in order to increase a contact area with the honeycomb paper and to reduce the contacting force applied to the honeycomb paper and to balance the acting force acting on the honeycomb paper, this being provided to demonstrate the modifiability of the present invention.

Figure 6:
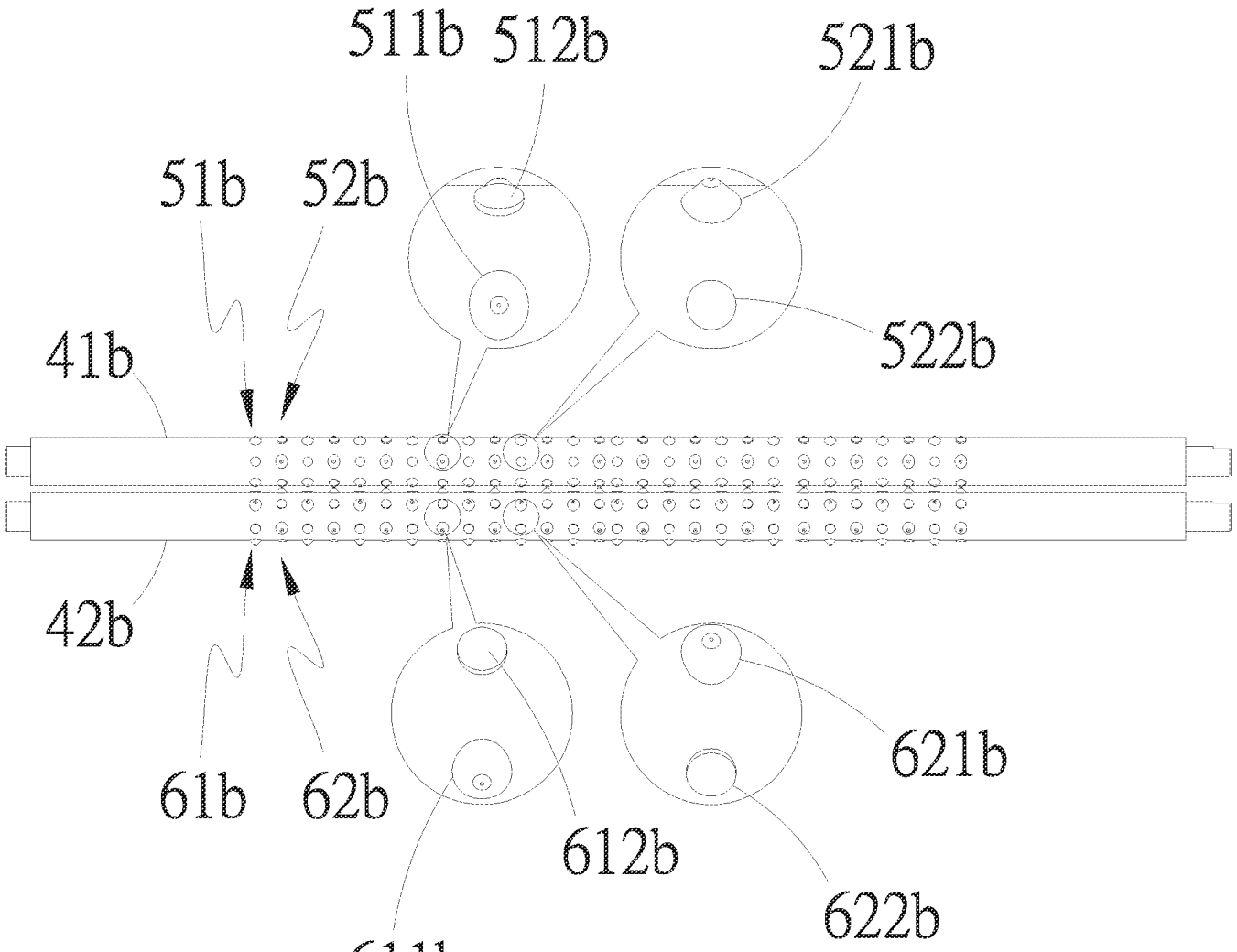
FIG. 6 is a plan view showing an expansion roller assembly according to a further preferred embodiment of the present invention.

As shown in FIG. 6, which is a plan view showing an expansion roller assembly according to a further preferred embodiment of the present invention, it can be clearly seen from the drawings that the instant embodiment is generally similar to the previous embodiments and is differently structured such that the first upper projection assemblies 51*b* and the second upper projection assemblies 52*b* are integrally formed, as one piece, on the upper expansion roller 41*b*, and the first lower projection assemblies 61*b* and the first lower projection assemblies 61*b* are integrally formed, as one piece, on the lower expansion roller 42*b*, and the first upper projecting portions 511*b*, the second upper projecting portions 521*b*, the first lower projecting portions 611*b*, and the second lower projecting portions 621*b* are arranged, as an example for illustration, in the form of conic surface projections, and the first upper supporting portions 512*b*, the second upper supporting portions 522*b*, the first lower supporting portions 612*b*, and the second lower supporting portions 622*b* are arranged as cylinders provided on the upper expansion roller 41*b* or the lower expansion roller 42*b*, in order to use the cylinders for height compensation for control of the size of the surface projections.

Figure 7:
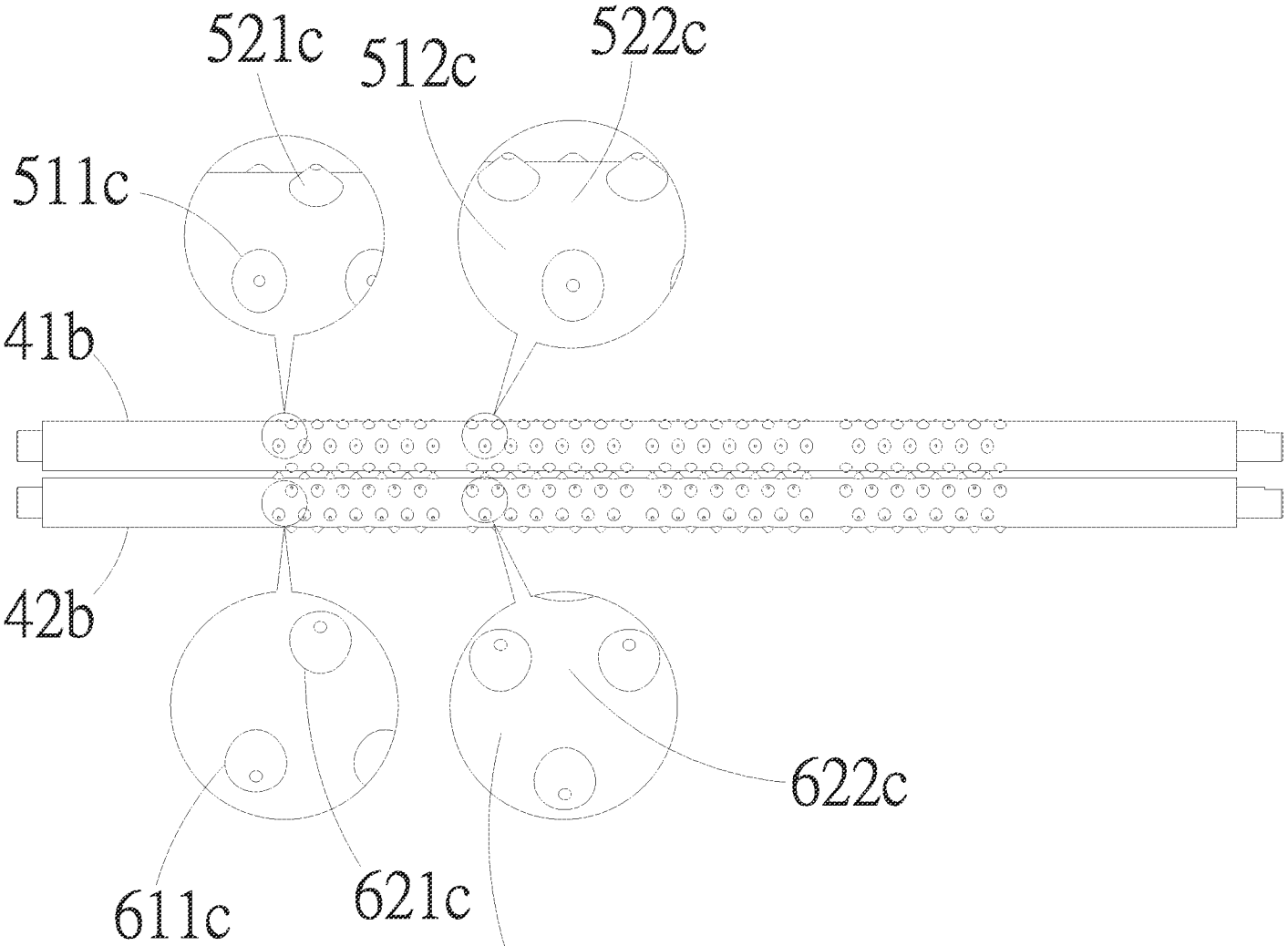
FIG. 7 is a plan view showing an expansion roller assembly according to yet a further preferred embodiment of the present invention.

As shown in FIG. 7, which is a plan view showing an expansion roller assembly according to a further preferred embodiment of the present invention, it can be clearly seen from the drawings that the instant embodiment is generally similar to the previous embodiments and is differently structured such that the spacing distance between the first upper projecting portions 511*c* and the second upper projecting portions 521*c* is reduced, and the spacing distance between the first lower projecting portions 611*c* and the second lower projecting portions 621*c* is reduced (meaning the above-discussed arrangement of the upper spacing portions and the lower spacing portions is omitted), and in the instant embodiment, the surface projections are of a configuration of circular platform, and the first upper supporting portions 512*c*, the second upper supporting portions 522*c*, the first lower supporting portions 612*c*, and the second lower supporting portions 622*c* are arranged as circular arc surfaces of the upper expansion roller 41*c* or the lower expansion roller 42*c*.

I claim:

1. A structure of honeycomb paper expanding machine, the expanding machine being adapted to expand or stretch a honeycomb paper, the honeycomb paper includes a plurality of connecting portions and a plurality of cutoff portions, the expanding machine mainly comprising:

a chassis;

a feeding roller, which is rotatably mounted at an end of the chassis and is provided for bear and support the honeycomb paper;

a guiding roller, which is rotatably mounted to the chassis and is arranged at one side of the feeding roller;

an expansion roller assembly, which is rotatably mounted to the chassis and is arranged at one side of the guiding roller that is opposite to the feeding roller, wherein the expansion roller assembly comprises an upper expansion roller, a lower expansion roller arranged on one side of the upper expansion roller and rotatable in a direction opposite thereto, and a passage gap formed between the upper expansion roller and the lower expansion roller;

a plurality of first upper projection assemblies, which are arranged in a manner of circumferentially surrounding and mounted to the upper expansion roller at intervals in an axial direction, wherein the first upper projection assemblies each comprise a plurality of first upper projecting portions arranged in a manner of being spaced from each other in a longitudinal direction, and a plurality of first upper supporting portions arranged alternate with respect to the first upper projecting portions;

a plurality of second upper projection assemblies, which are arranged in a manner of circumferentially surrounding and mounted to the upper expansion roller at intervals in an axial direction and are arranged alternate with respect to the first upper projection assemblies, wherein the second upper projection assemblies each comprise a plurality of second upper projecting portions arranged in a manner of being spaced from each other in a longitudinal direction and are located at one side of each of the first upper supporting portions, and a plurality of second upper supporting portions arranged alternate with respect to the second upper projecting portions and are located at one side of each of the first upper projecting portions;

a plurality of first lower projection assemblies, which are arranged in a manner of circumferentially surrounding and mounted to the lower expansion roller at intervals in an axial direction, wherein the first lower projection assemblies each comprises a plurality of first lower projecting portions arranged in a manner of being spaced from each other in a longitudinal direction, and a plurality of first lower supporting portions are arranged alternate with respect to the first lower projecting portions; and a plurality of second lower projection assemblies, which are arranged in a manner of circumferentially surrounding and mounted to the lower expansion roller at intervals in an axial direction and are arranged alternate with respect to the first lower projection assemblies, wherein the second lower projection assemblies each comprises a plurality of second lower projecting portions arranged in a manner of being spaced from each other in a longitudinal direction and are located at one side of each of the first lower supporting portions, and a plurality of second lower supporting portions arranged alternate with respect to the second lower projecting portions and are located at one side of each of the first lower projecting portions;

wherein the expansion roller assembly, during rotation, is operable such that the first upper projecting portions and the first lower supporting portions that are located at one side of the passage gap are set to correspond, in position, to each other; the second upper projecting portions and the second lower supporting portions that are located at one side of the passage gap are set to correspond, in position, to each other; the first lower projecting portions and the first upper supporting portions that are located at one side of the passage gap are set to correspond, in position, to each other; and the second lower projecting portions and the second upper supporting portions that are located at one side of the passage gap are set to correspond, in position, to each other;

wherein the first upper projection assemblies and the second upper projection assemblies are arranged on at least one first fitting joint portion, and the first lower projection assemblies and the second lower projection assemblies are arranged on at least one second fitting joint portion.

2. The structure of honeycomb paper expanding machine according to claim 1, wherein upper spacing portions are arranged between the first upper projection assemblies and the second upper projection assemblies, and lower spacing portions are arranged between the first lower projection assemblies and the second lower projection assemblies.

3. The structure of honeycomb paper expanding machine according to claim 1, wherein the first upper projection assemblies and the second upper projection assemblies are integrally formed, as one piece, on the upper expansion roller, and the first lower projection assemblies and the second lower projection assemblies are integrally formed, as one piece, on the lower expansion roller.

4. The structure of honeycomb paper expanding machine according to claim 1, wherein the first upper projecting portions, the second upper projecting portions, the first lower projecting portions, and the second lower projecting portions are surface projections.

5. The structure of honeycomb paper expanding machine according to claim 4, wherein the surface projections are of a shape of one of a cone, an arc, or a circular platform.

6. The structure of honeycomb paper expanding machine according to claim 1, wherein the first upper supporting portions, the second upper supporting portions, the first lower supporting portions, and the second lower supporting portions are circular arc surfaces.

7. The structure of honeycomb paper expanding machine according to claim 1, wherein the first upper projecting portions, the second upper projecting portions, the first lower projecting portions, and the second lower projecting portions are provided in array arrangements.

8. The structure of honeycomb paper expanding machine according to claim 1, wherein the first upper projecting portions, the second upper projecting portions, the first lower projecting portions, and the second lower projecting portions have a height of 1 mm-5 mm.

9. The structure of honeycomb paper expanding machine according to claim 1, wherein a spacing distance of the first upper projecting portions, a spacing distance of the second upper projecting portions, a spacing distance of the first lower projecting portions, and a spacing distance of the second lower projecting portions are in a range of 5 mm-100 mm.

* * * * *